United States Patent [19]

Kozacka et al.

[11] 4,386,334

[45] May 31, 1983

[54] SUPPORT ARRANGEMENT FOR A HELICALLY WOUND FUSIBLE ELEMENT

[75] Inventors: Frederick J. Kozacka, South Hampton; Richard A. Belcher, Hampton Falls, both of N.H.

[73] Assignee: Gould Inc., Electric Fuse Div., Newburyport, Mass.

[21] Appl. No.: 346,838

[22] Filed: Feb. 8, 1982

[51] Int. Cl.[3] ..... H01H 85/16

[52] U.S. Cl. ..... 337/251; 337/231; 337/252

[58] Field of Search ..... 337/158, 159, 161, 208, 337/231, 233, 248, 251, 252

[56] References Cited

U.S. PATENT DOCUMENTS 3,848,214 11/1974 Salzer ..... 337/252 X 4,001,748 1/1977 Salzer ..... 337/252 X

*Primary Examiner*—George Harris

*Attorney, Agent, or Firm*—Frederick A. Goettel, Jr.

[57] ABSTRACT

An electric fuse having a support for helically wound fusible element or elements. The support includes a plurality of rods which are supported at their opposite ends adjacent the fuse end terminal by rod supports each of which is made from a pair of angularly arranged sheet-metal channels. The channels have a U-shaped cross-section and are arranged with their open ends facing the center of the fuse housing. Centrally positioned sections of the channels are flattened to facilitate rigid attachment of the channels to one another. The ends of the rods are received in and attached to interior portions of the U-shaped channels. A sub-assembly comprising the rods, rod supports and the wound fusible elements is pre-assembled and, when placed in a fuse housing, the ends of the channels cooperate with the inside walls of the housing to properly position the entire assembly.

8 Claims, 5 Drawing Figures

SUPPORT ARRANGEMENT FOR A HELICALLY WOUND FUSIBLE ELEMENT

BACKGROUND OF THE INVENTION

1. Field of the Invention

This invention relates to fuses intended primarily for elevated or medium circuit voltages, i.e., circuit voltages of 5 KV to 15 KV. It may be applied to higher or lower circuit voltages but is particularly useful in the manufacture of fuses for use in the above noted voltage range.

2. Description of the Prior Art

A known prior art fuse for use with this voltage range includes a tubular housing and a pair of electroconductive terminal elements which serve to close the tubular housing at its ends. A pulverulent arc-quenching filler is contained within the housing. A substantially helically wound fusible element is embedded in the arc-quenching filler and is conductively interconnected at opposite ends to the pair of terminal elements. A plurality of rods extending in a direction longitudinally of the casing are provided for supporting the fusible element which is helically wound thereabout. A pair of rod supports are provided adjacent each end of the housing for supporting the ends of the plurality of rods.

The following U.S. Patents are representative of the prior art with respect to such fuses: U.S. Pat. Nos. 3,573,699 issued to E. Salzer; 3,611,238 issued to F. Kozacka; 3,680,019 issued to F. Kozacka; 3,810,061 issued to E. Salzer; 3,870,984 issued to E. Salzer; 3,881,161 issued to F. Kozacka; 3,851,289 issued to F. Kozacka; 3,962,666 issued to E. Knapp, Jr.; 4,001,749 issued to F. Kozacka; 4,021,765 issued to F. Kozacka & R. Belcher; and 4,034,328 issued to E. Salzer.

Prior art fuses of the type described hereinabove had little cost-effectiveness. It is therefore a principal object of this invention to provide fuses of the aforementioned description which are more cost effective than comparable prior art fuses. Other objects of the invention and advantages thereof will become more apparent as this specification proceeds.

SUMMARY OF THE INVENTION

The invention comprises a complete fuse including all the parts that are necessary for its proper performance, and it comprises also a rod support as such which may be used for manufacturing any kind of fuse calling for a rod support.

A complete fuse according to the present invention comprises a pair of rod supports of which each is made of a pair of angularly arranged sheet-metal channels. Each channel includes a web and a pair of flanges. The webs are arranged in close proximity to the terminal elements of the fuse and the flanges project toward the center of the housing. When installed within the housing the ends of the pair of sheet-metal channels are in close proximity to the inside of the housing, i.e. their length is slightly less than the inside diameter of the housing, to limit possible movement of the pair of sheet-metal channels relative to the housing. Juxtapposed portions of the flanges of either one or both sheet-metal channels of which the rod support is formed are cut-out from the rest of the pair of flanges and bent from their normal positions into the plane of the web to which the portions are attached so that a passageway is formed extending transversely across one or both of the rod-support-forming sheet-metal channels. The other of the pair of rod-support-forming sheet-metal channels is inserted into the passageway so that its web is parallel to and in close proximity or in actual physical engagement with the web of the first mentioned sheet-metal channel. The webs of both rod supporting sheet-metal channels are connected by suitable conventional fastening means such as rivets or eyelets etc. to each other.

BRIEF DESCRIPTION OF THE DRAWINGS

The novel features that are considered characteristic of the invention are set forth with particularly in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

DESCRIPTION OF THE PREFERRED EMBODIMENTS

Figure 1:
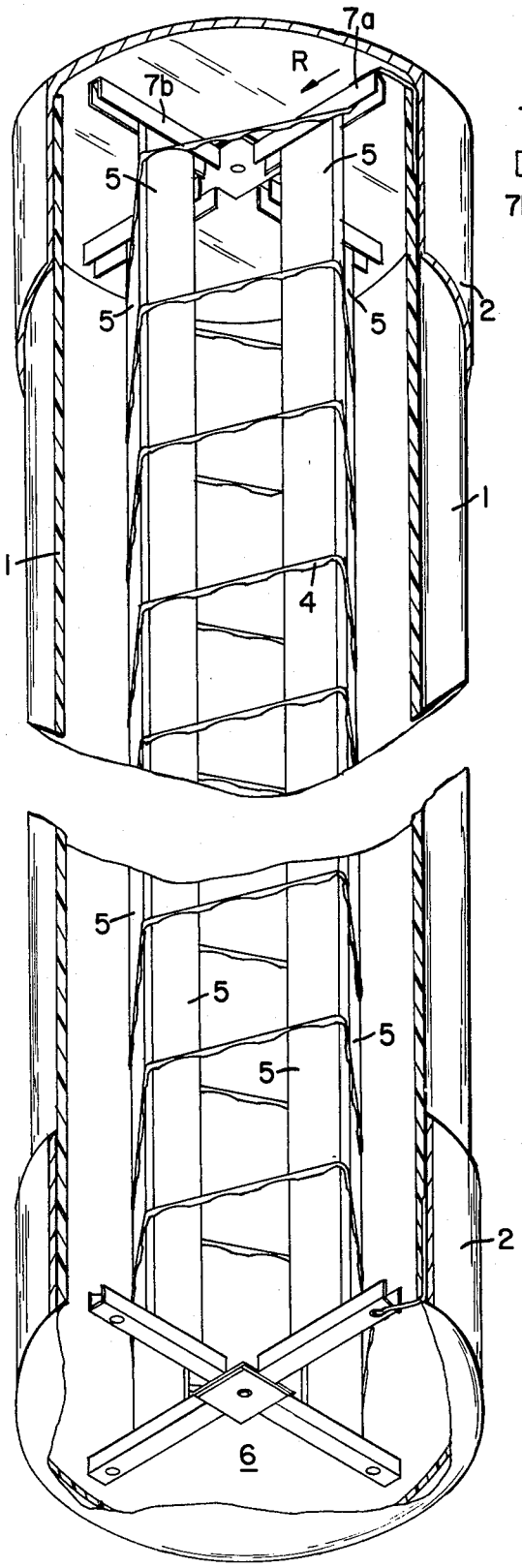
FIG. 1 is an isometric view of a fuse according to the present invention with some of its parts broken away to expose other of its parts.

Referring now to the drawings reference numeral 1 has been used to indicate a tubular housing which is closed at the ends thereof by a pair of electroconductive terminal elements or caps 2. A pulverulent arc-quenching filler 3, e.g. quartz sand, is provided inside of housing 1. A substantially helically wound fusible element 4 is embedded in the arc-quenching filler 3 and conductively interconnects the pair of terminal elements 2. A support for the fusible element 4 includes a plurality of parallel rods 5 which extend in a direction longitudinally of the housing 1. The rods 5 are made from an electric insulating material such as ceramic or of a material evolving arc-quenching gas jets under the action of electric arcs. It is also possible to make some of the rods 5 from a ceramic material that does not evolve gases under the action of electric arcs, and others of rods 5 from gas evolving materials.

Figure 4:
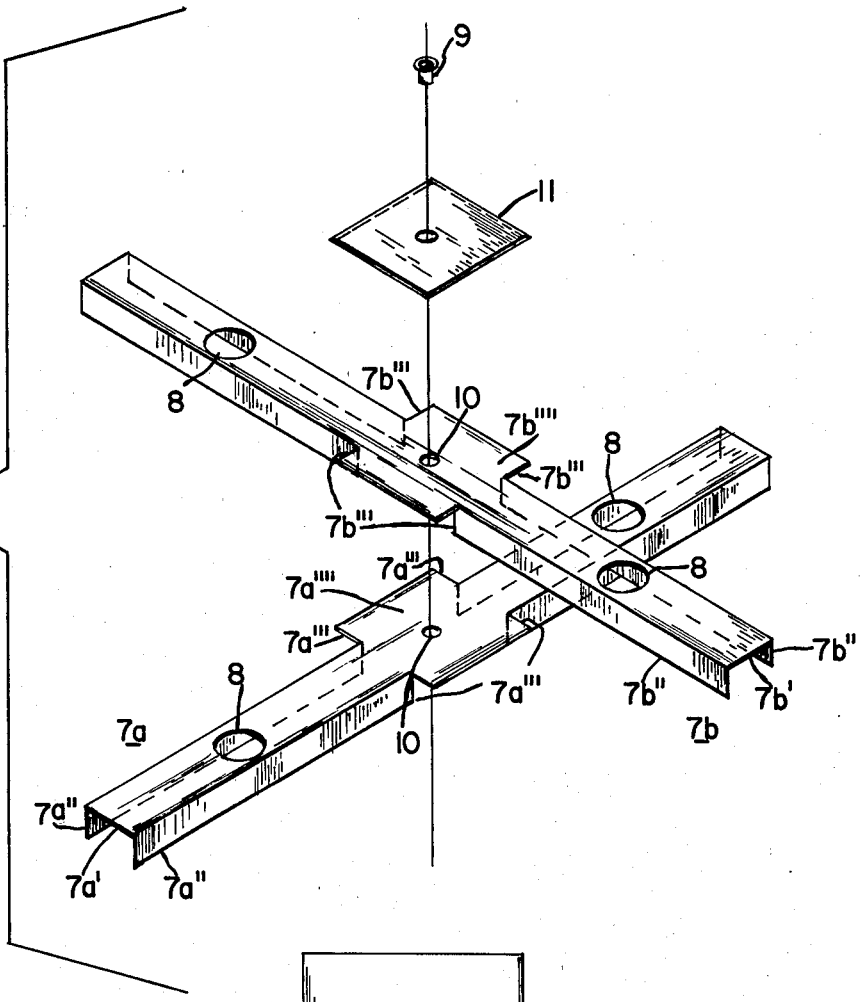
FIG. 4 is an exploded isometric view of the individual parts of a rod supporting assembly of the preferred embodiment of the invention.

The fusible element supporting rods 5 are in turn supported by a pair of rod support means generally designated by reference numeral 6. Each rod support means 6 comprises a pair of crosswise arranged sheet-metal channels *7a* and *7b*. Each of the sheet-metal channels *7a* and *7b* are of a length slightly less than the inner diameter of the tubular housing 1. As best shown in FIG. 4, it will be seen that the channels *7a* and *7b* include centrally extending web portions *7a'* and *7b'*, respectively, which each interconnect respectively, a pair of flange portions *7a''* and *7b''*.

In the preferred embodiment a pair of spaced apart cuts *7a'''* and *7b'''* are made in each of the pair of flanges *7a''* and *7b''* near the center thereof, which extend up to but not into the web portions 7a' and 7b'. The portions of the flanges 7a'' and 7b'' lying between the pair of cuts 7a''' and 7b''' are bent into the plane defined by their respective web portions 7a' and 7b' to define, in cooperation with the portion of the webs 7a' and 7b' lying between and interconnecting the bent flange portions, a pair of flattened out channel sections 7a'''' and 7b''''.

The flattened sections 7a'''' and 7b'''' and the edges of the flanges 7a'' and 7b'' where the cuts 7a''' and 7b''' were made cooperate to define passageways extending transversely across the respective channels 7a and 7b.

Figure 2:
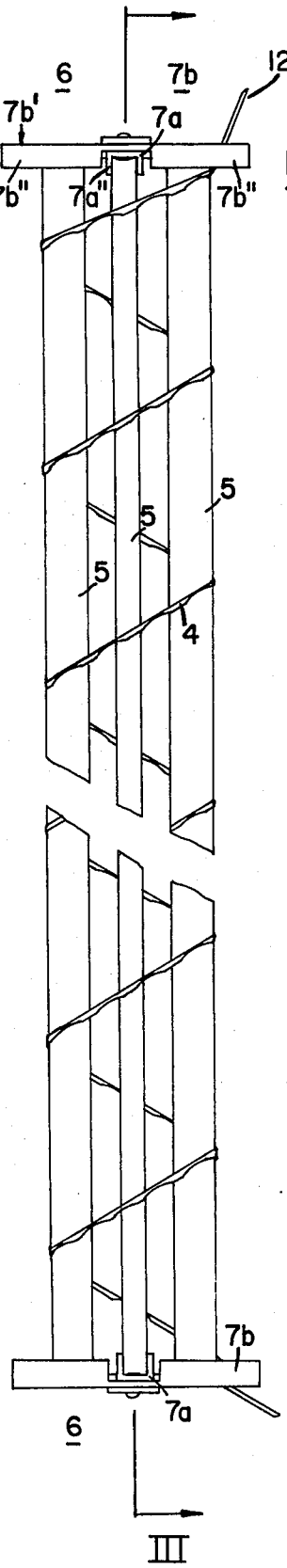
FIG. 2 is a front view of the inner parts of the fuse of FIG. 1 as viewed in the direction of the arrow-R of FIG. 1.
Figure 3:
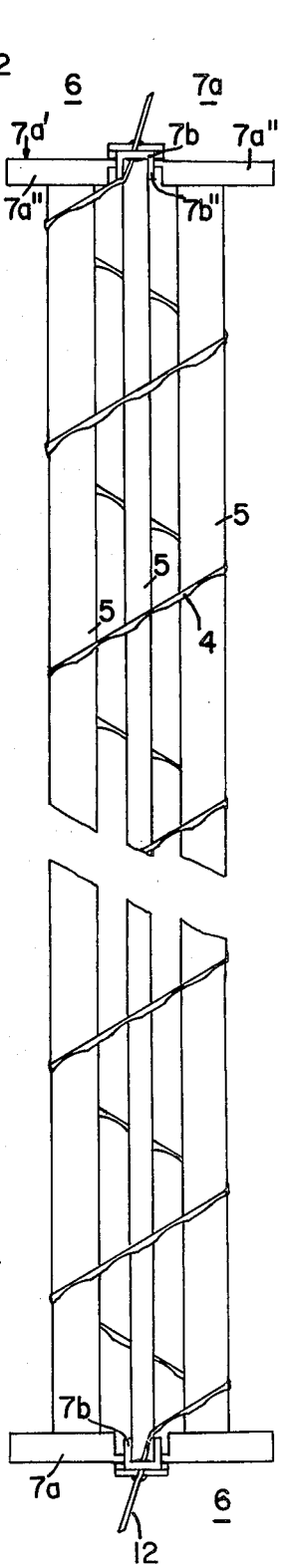
FIG. 3 is substantially a section along the line III—III of FIG. 2.
Figure 5:
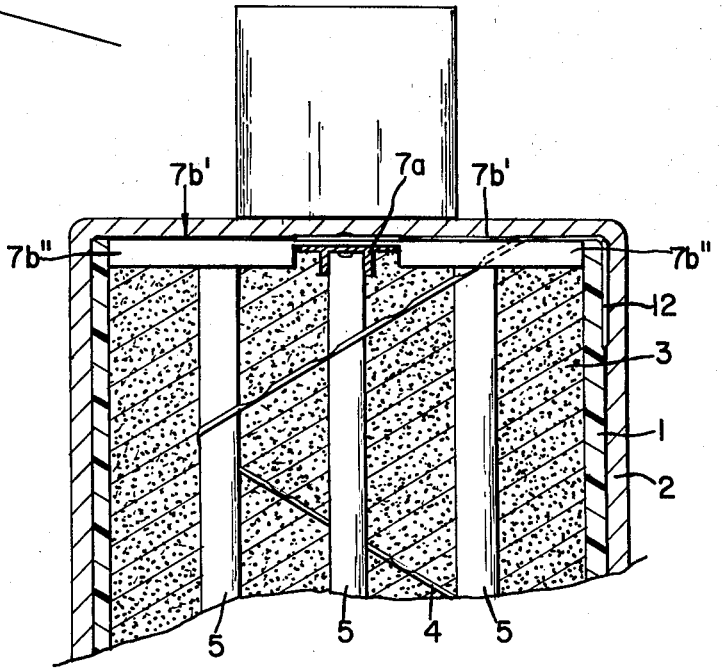
FIG. 5 is in substance a vertical section through a fuse embodying this invention with some of its parts shown in elevation rather than sectionalized.

Assembly of each of the rod support means 6 is accomplished by inserting the channel 7a into the transverse passageway of the channel 7b so that the flattened out channel sections 7a'''' and 7b'''' are in overlapping relationship. Preferably, as shown in FIGS. 2,3 and 5 the flattened sections are in direct face to face congruent contact with one another. Further, in the preferred arrangement the channels 7a and 7b are positioned so that they extend perpendicular to one another.

Once aligned as described above the channel 7a is rigidly attached to the channel 7b by suitable means such as a rivet 9 which extends through aligned openings 10 provided in the respective flattened portions 7a'''' and 7b'''' of the channels 7a and 7b. The attachment of the channels may be facilitated by providing an overlying reinforcing plate 11 as best seen in FIG. 4. Further, the parts may be permanently attached to one another by use of a suitable adhesive such as an epoxy resin or by soldering.

With particular reference to FIGS. 4 and 5 it will be seen that the webs 7a' and 7b' are each provided with several openings 8, any one of which through the ends 12 of the fusible element 4 may be threaded. The ends 12 so threaded are then bent over on the outside of the housing 1 where they may then be electrically connected as by soldering to the end caps, or terminals 2.

To manufacture a fuse embodying this invention involves preliminary assembly of a sub-assembly such as that shown in FIGS. 2 and 3. The sub-assembly is formed by making first a pair of rod support means 6 as set forth above. The plurality of fusible element support rods 5 are then attached to the inside of the channels 7a and 7b at the desired positions by suitable means such as an epoxy resin adhesive. Preferably, to facilitate attachment, the dimension of the rods extending between the flanges of the channels is substantially the same as the spacing between the flanges.

The fusible element 4 is then wound around the support structure defined by the rods and the ends 12 are threaded out through an opening 8 to result in the sub-assembly shown in FIGS. 2 and 3.

The sub-assembly may then be readily inserted into a cylindrical housing 1 having a length substantially equal to that of the sub-assembly. Thus inserted, the outer ends of at least several of the channels 7a and 7b contact the inner cylindrical wall of the housing and, because the channels 7a and 7b are only slightly less in length than the inner diameter of the housing the sub-assembly, most importantly, the fusible element, is supported in its desired position with respect to the housing by such contact of the channels.

Following insertion of the sub-assembly, one end of the fusible element is bent over and soldered to its respective end cap as described above. The fuse is then filled with the filler material 3 prior to the other end cap being attached in a like manner.

Accordingly it will be appreciated that as a result of this invention electric fuses, of the type having fusible elements which are helically wound around a supporting structure of electric insulating material, may be manufactured which are significantly more cost-effective, both from the standpoint of materials used and labor required, than those heretofor known.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claims are intended to be embraced therein.

We claim as our invention:

1. An electric fuse for elevated circuit voltages including:

a. a tubular housing of an electric insulating material;

b. a pair of electroconductive terminal elements closing said housing at the ends thereof;

c. a pulverulent arc-quenching filler inside said housing;

d. a substantially helical fusible element inside said housing, submerged in said arc-quenching filler and conductively interconnecting said pair of terminal elements;

e. a plurality of rods of electric insulating material extending in a direction longitudinally of said housing and supporting said fusible element;

f. a pair of rod supports arranged at the ends of said housing for supporting the ends of said plurality of rods, wherein;

g. each of said pair of rod supports includes a pair of angularly arranged sheet-metal channels, each comprising a web and each comprising a pair of flanges, said web of each of said pair of sheet-metal channels being arranged in close proximity to one of said pair of terminal elements and said pair of flanges of each of said pair of sheet-metal channels projecting toward the longitudinal center of said housing;

h. said pair of sheet-metal channels having ends in close proximity to said housing to limit possible movement of said pair of sheet-metal channels relative to said housing;

i. juxtapposed portions of both of said pair of flanges of at least one of said pair of sheet-metal channels being cut-off from the rest of said pair of flanges, and bent from their normal positions into the plane of the web to which said portions are attached so that a passageway is formed extending transversely across at least said one of said pair of sheet-metal channels;

j. the other of said pair of sheet-metal channels being inserted into said passageway so that said web of said other of said pair of sheet-metal channels is parallel and in close proximity to the web of said one of said pair of sheet-metal channels; and k. means for mechanically connecting said web of said one and said web of said other of said pair of sheet-metal channels.

2. An electric fuse as specified in claim 1 wherein juxtapposed portions of said flanges of each of said pair of sheet-metal channels are cut-off at two spaced points from the rest of said flanges, and bent out from their normal positions into the plane of the web to which said cut-off portions are attached so that a passageway is formed extending transversely across each of said pair of sheet-metal channels, and wherein one of said pair of sheet-metal channels is inserted into said passageway of the other of said pair of sheet-metal channels in such a way that said bent portions of said flanges of said pair of sheet-metal channels overlap.

3. An electric fuse as specified in claim 2 wherein said pair of sheet-metal channels are substantially congruent and wherein said bent out flange portions are substantially congruent.

4. An electric fuse as specified in claim 1 wherein said terminal elements are in the form of caps mounted on the ends of said housing, and wherein said webs of said pair of sheet-metal channels are provided with openings through which said fusible element is threaded so as to engage the inside of said caps.

5. A rod support for supporting the rods around which the helical fusible elements of a fuse for elevated circuit voltages are wound comprising:

a. a first sheet-metal channel including a first web and a first pair of flanges projecting from said first web;
b. a second sheet-metal channel including a second web and a second pair of flanges projecting from said second web;
c. said first web and said second web enclosing a predetermined angle;
d. juxtapposed portions of said first pair of flanges being severed from the rest of said first pair of flanges at two spaced points near the center of said first pair of flanges and bent into the plane defined by said first web whereby a passageway is formed transversely across said first sheet-metal channel;
e. said second sheet-metal channel being inserted into said passageway in such a fashion that the web of said second sheet-metal channel is parallel and in close proximity of said web of said first sheet-metal channel and said bent portion of said first sheet-metal channel; and
f. means for affixing said first sheet-metal channel to said second sheet-metal channel.

6. A rod support for supporting the rods around which the helical fusible elements of a fuse for elevated circuit voltages are wound comprising:

a. a first sheet-metal channel including a first web and a first pair of flanges projecting from said first web;
b. a second sheet-metal channel including a second web and a second pair of flanges projecting from said second web;
c. said first web and said second web enclosing a predetermined angle;
d. juxtapposed portions of said first pair of flanges being severed from the rest of said first pair of flanges at two spaced points near the center of said first pair of flanges and bent into the plane defined by said first web whereby a passageway is formed transversely across said first sheet-metal channel;
e. juxtapposed portions of said second pair of flanges being severed from the rest of said pair of flanges at two spaced points near the center of said second pair of flanges and bent into the plane defined by said second web;
f. said second sheet-metal channel being inserted into said passageway in such a fashion that said first web and said second web are parallel and in close proximity to each other and that bent portions of said first pair of flanges overlaps said bent portions of said second pair of flanges; and
g. means for affixing said first sheet-metal channel to said second sheet-metal channel projecting through said first web and through said second web.

7. A rod support for supporting the rods around which the helical fusible elements of a fuse for elevated circuit voltages are wound comprising:

a. a first channel of sheet-metal having a first web and a first pair of flanges projecting from said first web;
b. a second channel of sheet-metal having a second web and a second pair of flanges projecting from said second web;
c. said first web and said second web extending in directions which intersect with one another, said first web and said second web abutting with one another, and said first pair of flanges and said second pair of flanges projecting in the same direction from said first web and said second web;
d. juxtapposed portions of said first flanges being severed, near to the intersection of the directions of said first web and of said second web, from the rest of said first flanges and bent from their normal positions into the plane defined by said first web;
e. juxtapposed portions of said second flanges being severed, near to the intersection of the directions of said first web and of said second web, from the rest of said second flanges and bent from their normal positions into the plane defined by said second web;
f. said severed and bent portions of said first flanges and said severed and bent portions of said second flanges being arranged in abutting relation; and
g. fastener means attaching said first web and said second web to one another.

8. The rod support or claim 7 wherein the directions of said first web and said second web are perpendicular to one another.

* * * * *